US008794134B2

(12) United States Patent
Aebischer et al.

(10) Patent No.: US 8,794,134 B2
(45) Date of Patent: Aug. 5, 2014

(54) METHOD AND APPARATUS FOR FORMING BUNDLES IN A BUNDLE FORMER

(75) Inventors: Markus Aebischer, Rothenburg (CH); Roman Wyss, Oberbuchsiten (CH); André Roth, Zofingen (CH)

(73) Assignee: Mueller Martini Holding AG, Hergiswil (CH)

( * ) Notice: Subject to any disclaimer, the term of this patent is extended or adjusted under 35 U.S.C. 154(b) by 435 days.

(21) Appl. No.: 13/071,872

(22) Filed: Mar. 25, 2011

(65) Prior Publication Data

US 2011/0232511 A1 Sep. 29, 2011

(30) Foreign Application Priority Data

Mar. 25, 2010 (CH) ..... 0437/10

(51) Int. Cl.

| | |
|---|---|
| ***B30B 13/00*** | (2006.01) |
| ***B30B 15/16*** | (2006.01) |
| ***B30B 15/30*** | (2006.01) |
| ***B30B 9/00*** | (2006.01) |

(52) U.S. Cl.
USPC ..... 100/35; 100/45; 100/238; 100/242; 414/788.3; 414/791; 414/792.2

(58) Field of Classification Search
USPC ..... 100/7, 35, 45, 264, 188 R, 267, 240, 100/238, 242, 245; 414/788.3, 791, 792.2
See application file for complete search history.

(56) References Cited

U.S. PATENT DOCUMENTS

| | | | | |
|---|---|---|---|---|
| 4,547,112 | A * | 10/1985 | Steinhart | 414/788.3 |
| 5,129,781 | A * | 7/1992 | Petersen | 414/791.2 |
| 5,346,206 | A * | 9/1994 | Steinhart | 271/305 |
| 5,353,576 | A * | 10/1994 | Palamides et al. | 53/540 |
| 5,387,077 | A * | 2/1995 | Yatsuka et al. | 414/791 |
| 6,571,694 | B1 * | 6/2003 | Gustafsson | 100/151 |
| 7,320,573 | B2 * | 1/2008 | Jones et al. | 414/790.3 |
| 2004/0140607 | A1 * | 7/2004 | Honegger | 271/183 |

FOREIGN PATENT DOCUMENTS

| | | | | |
|---|---|---|---|---|
| EP | 0309745 | | 4/1989 | |
| EP | 1593633 | | 11/2005 | |
| EP | 1739635 | | 1/2007 | |
| EP | 1826164 | | 1/2007 | |
| EP | 1760020 | | 3/2007 | |
| JP | 7257804 | A1 * | 9/1995 | B30B 15/16 |
| JP | 7257804 | | 10/1995 | |
| WO | WO-03/099692 | | 12/2003 | |

OTHER PUBLICATIONS

International Search Report of CH0437/2010 Dated Jul. 12, 2010 With English Translation.

* cited by examiner

*Primary Examiner* — Jimmy T Nguyen
*Assistant Examiner* — Onekki Jolly
(74) *Attorney, Agent, or Firm* — Venable LLP; Robert Kinberg

(57) ABSTRACT

An apparatus for a forming bundle composed of at least one layer of printed products includes a lift, wherein an area above the lift constitutes a holding space to accommodate the at least one layer. The lift is adapted to lower the at least one layer. A control unit is connected to control movement of the lift. A thickness determining device is coupled to the control unit and arranged to determine a thickness of the at least one layer. The lift is controlled to be lowered corresponding to a previously determined thickness of a layer to accommodate a following layer of a bundle or to accommodate a layer of a following bundle.

13 Claims, 4 Drawing Sheets

METHOD AND APPARATUS FOR FORMING BUNDLES IN A BUNDLE FORMER

CROSS-REFERENCE TO RELATED APPLICATION

This application claims the priority of Swiss Patent Application No. 00437/10, filed on Mar. 25, 2010, the subject matter of which is incorporated herein by reference.

BACKGROUND OF THE INVENTION

The present invention relates to a method for forming bundles in a bundle former that comprises a holding space in which at least one layer, composed of at least one printed product, of a bundle is deposited on a lift and is then compressed. With a method of this type, printed products made available in an overlapping flow, for example newspapers, magazines, brochures and the like, can be converted to a bundle during the further print processing operation. For an optimum bundle quality, the layers of printed products in a bundle are respectively compressed or compacted with the aid of the lift and a counter-pressure device, for example a pressing plate, before they leave the bundle former for the further processing locations. A bundle of this type comprises at least one layer which is generally composed of several individual printed products. Also known is a process of stacking the individual layers in a stacker, for example a compensating stacker, that is to say, in such a way that the backs of the printed products of successive layers are arranged opposite each other.

A method of this type is disclosed in European Patent document EP-A-1 593 633. With this method, the layers to be compressed are formed with the aid of a stacking device which is arranged above the holding space of a pressing device and which takes over the printed products from an overlapping flow. The layers are respectively dropped onto the lift of the pressing device which is then raised toward press flaps for the compressing of the layer. To accommodate an additional layer, the lift is lowered and is subsequently raised once more for the compressing. Finally, the formed bundle is lowered completely and is ejected.

European patent document EP-A-1 826 164 discloses a bundler former equipped with pivoting pressure levers which are placed from above against the formed stack. For the pressing operation, the distance between a bottom of the holding space and the pressure levers is reduced.

European patent document EP-A-0 309 745 discloses an apparatus for which the printed products are deposited with the aid of a pivoting feeder onto a stacking table. The stacking table is lowered corresponding to the pivoting angle of the feeder until a partial stack is formed.

With the aforementioned method, bundles must generally be formed at an extremely high output, wherein the printed products supplied to the bundle former are to be stacked to form an optimum bundle and are transferred out for the further processing during the shortest possible time interval. The respective cycle time should therefore be as short as possible. At the same time, a constant high bundle quality should also be ensured.

SUMMARY OF THE INVENTION

It is an object of the present invention to provide a method and an apparatus for forming bundles which allow a shorter cycle time.

The above and other objects are achieved according to the invention by the provision of a method for forming bundles inside a bundle former having a holding space, which in one embodiment comprises: depositing at least one layer, composed of at least one printed product of a bundle, onto a lift; subsequently compressing a respective one of the layers; determining a thickness of the respective layers; and moving the lift downward, corresponding to the previously determined thickness of a respective one of the layers for accommodating a following layer of the bundle or a layer of a following bundle.

Thus according to the foregoing method, the thickness of the at least one layer of printed products is determined and the lift for accommodating a following layer in the bundle, or a layer belonging to a different bundle, is moved downward by an amount which corresponds to the previously determined thickness. For accommodating a following layer, the lift is thus lowered corresponding to the thickness determined for the previous layer, so that it is always moved to the optimum position. Measuring the thickness of the previous layer therefore makes it possible to optimally control the lift positions for accommodating a following layer. The height for dropping the new layer can thus be kept at a minimum which is advantageous in view of the bundle quality.

The thickness of a compressed layer as well as the thickness of a non-compressed layer can be used. According to another embodiment, the thickness of a compressed layer is determined during the pressing operation. Such a measurement can be obtained easily, but is nevertheless precise, if it is taken via the lift position. According to a further embodiment, a position sensor is integrated into the lift for this, which is designed to measure the positions of the lift. Based on such a measurement and the thickness computed therewith, the lift is then lowered accordingly for accommodating the following, equally large layer.

If the thickness of a non-compressed layer is used, then the thickness of the compressed layer is computed by taking into account a corresponding air factor, wherein simple experiments can be used to determine this factor.

According to one embodiment, the thickness of the first layer may be determined. The lift may then be lowered accordingly for accommodating a second layer. As a rule, the second layer and preferably also the additional layers have the same thickness. The lift can be lowered gradually, respectively corresponding to the previously determined layer thickness, which keeps the drop height for the following layer at a minimum. The lift may then be lowered gradually until the bundle is complete. Following this, the compressed and/or compacted bundle may be ejected, for example with the aid of an ejector, and then supplied for further processing locations.

According to a further aspect of the invention there is provided an apparatus for forming bundles composed of at least one layer of printed products which, according one embodiment, comprises: a lift, wherein an area above the lift constitutes a holding space to accommodate the at least one layer, the lift being adapted to lower the at least one layer; a control unit connected to control movement of the lift; and a thickness determining device coupled to the control unit and arranged to determine a thickness of the at least one layer, wherein the lift is controlled to be lowered corresponding to a previously determined thickness of a layer to accommodate a following layer of a bundle or to accommodate a layer of a following bundle.

Thus, according to the above, the apparatus for forming bundles has a thickness determining device that detects the thickness of the at least one layer of printed products so that the lift may be lowered, corresponding to a previously determined thickness, for accommodating a following layer in the bundle or a layer of a following bundle.

According to yet another embodiment, the aforementioned thickness determining device may be integrated into the lift. In particular, the thickness determining device may detect the respective height position of the lift during the pressing operation. A position sensor may be used, for example, for determining the lift position, wherein this sensor can determine the lift position either magnetically, optically or also mechanically. The measured thickness value may then be supplied to a control unit which may correspondingly lower the lift with the aid of a drive. The lift can be raised or lowered either hydraulically or pneumatically or also with the aid of an electric motor.

The apparatus according to the invention thus permits a shortening of the cycle time while simultaneously increasing the bundle quality.

BRIEF DESCRIPTION OF THE DRAWINGS

These and other features and advantages of the invention will be further understood from the following detailed description with reference to the accompanying drawings which show in.

DETAILED DESCRIPTION

Figure 1:
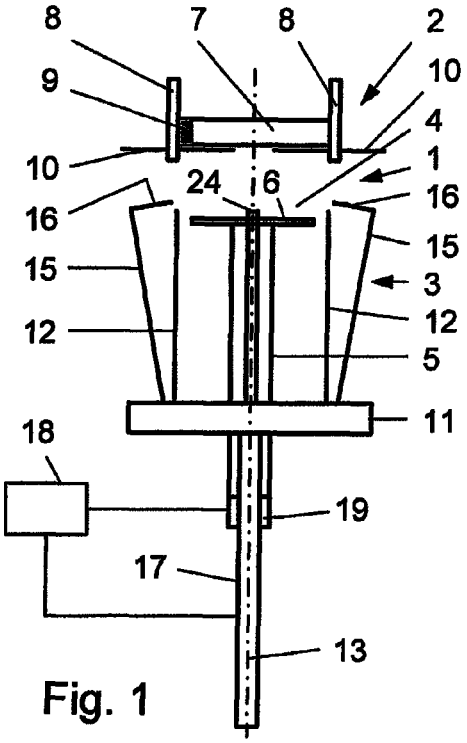
FIGS. 1 to 15 show respective schematic views of a bundle former according to the invention, wherein each Figure illustrates a separate phase of the method.

Referring to FIG. 1, there is shown a bundle former 1 that is embodied as a compensating stacker and is provided with a stacking device 2 and a compressing device 3. The stacking device 2 is arranged above a holding space 4 of the compressing device 3 and is open toward the top. Arranged inside the holding space 4 is a lift 5 that is provided with a horizontal lift plate 6 at the upper end, onto which a first layer 7, composed of one or several printed products, can be deposited or dropped. The printed products are supplied to the stacking device 2 in an overlapping flow, for example in a manner known per se that is not shown herein, and are deposited between adjustable side walls 8 or a similarly suitable formatting mechanism of the stacking device 2. The side walls 8 of the stacking device 2 can be adjusted to correspond to the format of the printed products. With the above-described support, the back 9 of each printed product comes to rest against the same side of the stacking device 2. The first layer 7 of printed products is formed on two opposite-arranged layer forks 10, or other suitable support on the stacking device 2, wherein these layer forks 10 are positioned at a specified distance above a table 11 for the compressing device 3.

The holding space 4 of the pressing device 3 is furthermore delimited on the side by side walls 12 which can be adjusted to match the format of the printed products. The lift 5 and the side walls 12 are positioned on the table 11 which can rotate by 180° around a vertical axis 13. As a result, it is possible to deposit successive layers 3 of printed products on the lift plate 6, with their backs 9 offset by 180° relative to each other. Of course, it is also possible to rotate the table 11 by 90°, so that the layers can be deposited in a cross pattern on the lift plate 6, wherein any other type of rotational angle is conceivable as well.

The first layer 7 and also a second layer 14 can be compressed through raising the lift plate 6. The layers are compressed by pushing them against press flaps 15, which are also arranged on the table 11 and which are respectively provided at one upper end with a press jaw 16. In FIG. 1, the press flaps 15 are shown in an inactive position in which they expose the holding space 4, so that the two layers 7 and 14 can be dropped. In order to compress each layer 7, 14, the press flaps 15 are respectively pivoted toward the inside, to the active position shown in FIG. 4.

The lift 5 is provided with a drive 17 which functions to move the lift plate 6 vertically up and/or down. The drive 17 can be embodied optionally and can be provided, for example, with a hydraulic or a pneumatic actuating cylinder. Also possible is a drive provided with a suitable motor, for example a servo motor. A control unit 18 functions to control the operations. The respective position of the lift plate 6 can be measured with the aid of a thickness determining device 19, for example embodied as a position sensor, which can determine the height position of the lift plate 6 above the locally fixed, rotating table 11. The thickness determining device 19 is preferably integrated into the lift 5 and can operate magnetically, optically or also mechanically. One skilled in the art is familiar per se with suitable devices 19, for example a position sensor that is integrated into a servo motor, wherein the required measuring tolerance is 1 mm for example. The control unit 18 is connected to the thickness determining device 19. Using appropriate signals, the device 19 transmits the respective position of the lift plate 6 and/or the measured height position of the lift plate 6 to the control unit 18. It is not absolutely necessary, however, for the thickness determining device 19 to be integrated into the lift 5. The position of the lift plate 6 could also be detected, for example, with the aid of an optical device, such as a laser-operated sensor, that is arranged outside of the lift 5.

Figure 2:
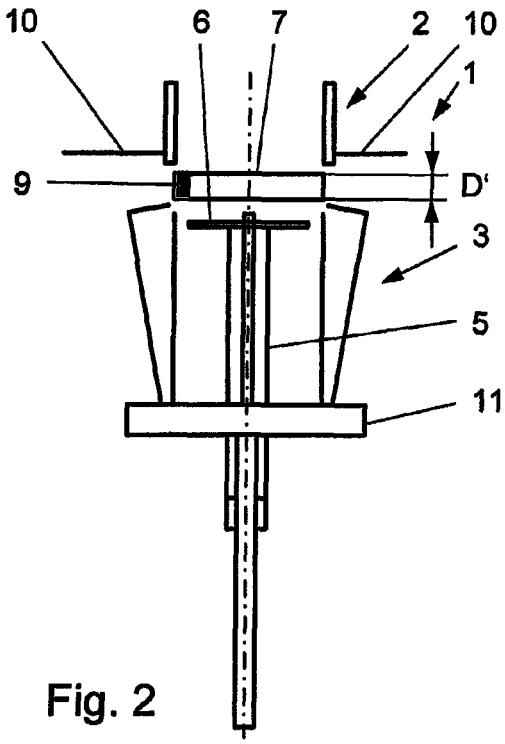
Figure 4:
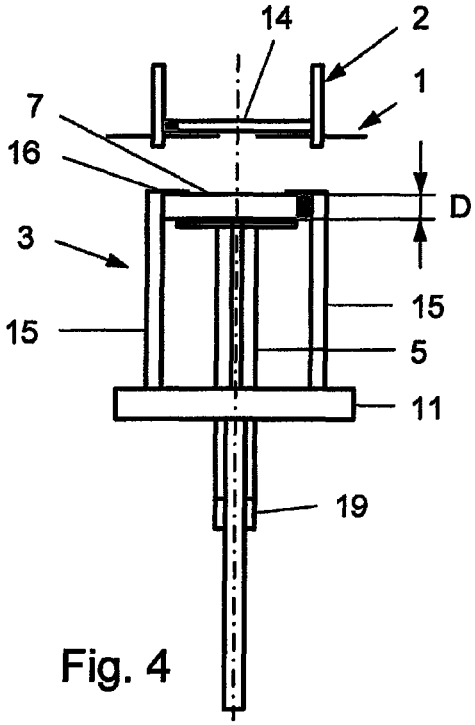

The device 19 is provided for determining the thickness of a compressed layer 7 which is given the reference D in FIG. 4, or the thickness of a non-compressed layer 7 which is given the reference D' in FIG. 2.

The method according to the invention is explained in further detail in the following with the aid of the Figures.

Figure 3:
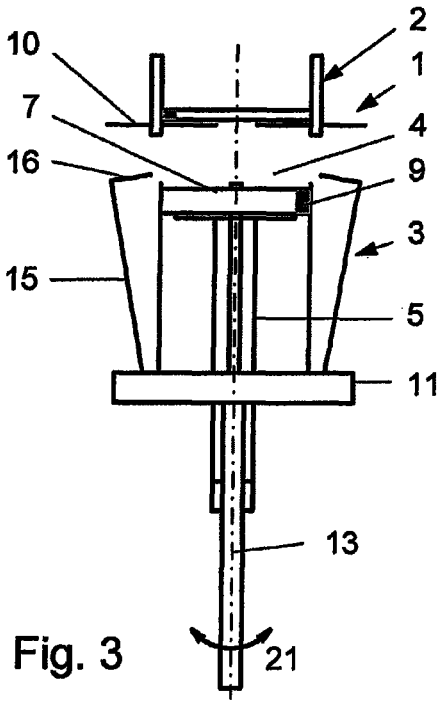

Once the first layer 7 is formed in the stacking device 2, the layer forks 10 are moved toward the outside, to the position shown in FIG. 2. As a result of the gravitational force, the first layer 7 consequently drops substantially vertically downward and onto the lift plate 6 which is in an upper position. The lift plate catches the first layer 7 and rotates this layer by 180° around the vertical axis 13 of the table 11, as indicated with the double arrow 21 in FIG. 3. As a result, the backs 9 of the printed products are in a position counter to their original orientation. The lift 5 then moves downward until the first layer 7 is located below the pivoting region for the press jaws 16 of the press flaps 15, as shown in FIG. 3. The latter are opened during this operation, so that the holding space 4 of the pressing device 3 is open toward the top and can thus accommodate the first layer 7. Approximately at the same time, the two layer forks 10 are moved back again to the position shown in FIG. 1.

The two press flaps 15 are then pivoted to the position shown in FIG. 4 and the second layer 14, composed of one or several printed products, is simultaneously formed in the stacking device 2. The lift 5 is then raised and the first layer 7 is consequently pressed against the press flaps 15, meaning against the press jaws 16 of these flaps. The thickness of the first layer 7 decreases during the pressing operation until, finally, the thickness D is reached. During the pressing operation, the position of the lift 5 is measured with the aid of the device 19. The thickness D of the compressed first layer 7 can be determined on the basis of this measurement and the known height position of the jaws 16. A signal corresponding to the determined thickness D is then transmitted by the means 19 to the control unit 18.

Figure 5:
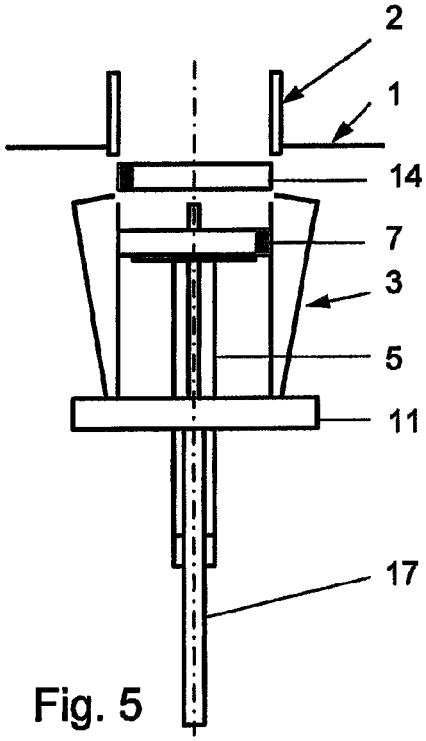
Figure 6:
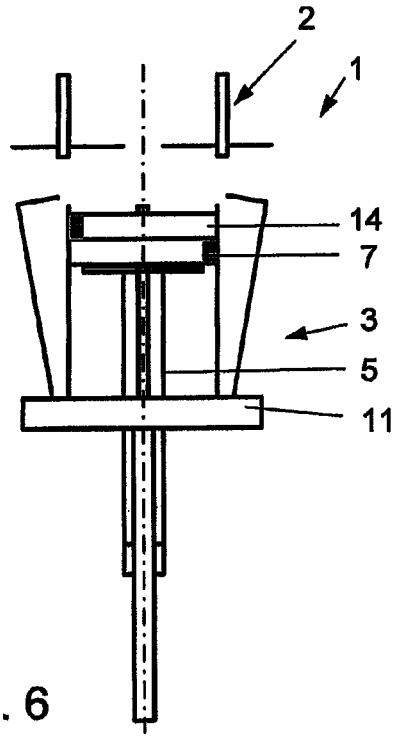

The control unit 18 controls the lift 5 to move downward to the position shown in FIG. 5. If a pneumatic drive 17 is used, its valves which are not shown herein are correspondingly opened and closed. The distance by which the lift 5 must be lowered is measured so as to correspond to the thickness determined for the compressed first layer 7. Alternatively, the thickness D' of the non-compressed first layer 7 can also be used as the starting value, based on which the thickness of the compressed first layer 7 is computed by taking into consideration an air factor. Once the lift 5 has reached the lower position, the second layer 14 of printed products is dropped onto the first layer 7, wherein the backs 9 of the printed products in the second layer 14 are deposited on the lift plate 6 with an offset of 180°, relative to the backs of the first layer 7. The distance by which the lift 5 is lowered somewhat exceeds the thickness determined for the first layer 7 which corresponds to the height difference between a compressed and a non-compressed layer 7. Following the dropping of the second layer 14, it is thus possible to pivot the press flaps 15 to the position shown in FIG. 7, without risking a collision. By raising the lift 5, the second layer 14 can also be compressed. The lift 5 is raised by a comparatively short distance since the thickness of the second layer 14 was taken into consideration during the aforementioned lowering of the lift 5. Essentially at the same time, another layer 20 of printed products is formed in the stacking device 2. However, such an additional layer 20 is not absolutely required because a bundle can also be formed with only the two layers 7 and 14, wherein a bundle can be formed that is composed of only a single layer 7. In that case, the determined thickness D of the single layer 7 of a first bundle is used for correspondingly positioning the lift 5, to accommodate the layer 7 of a following bundle.

Figure 7:
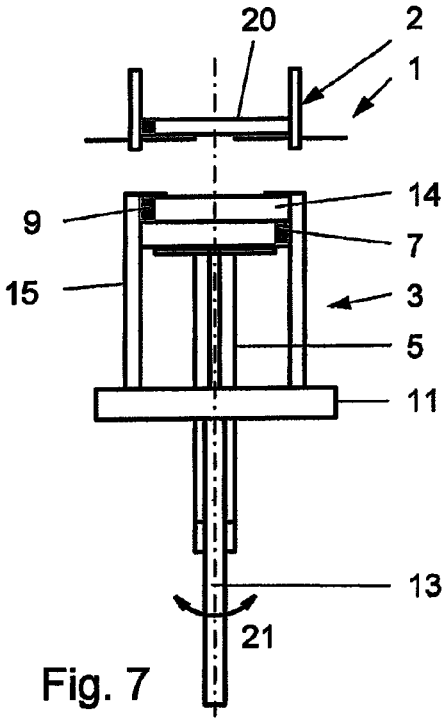
Figure 8:
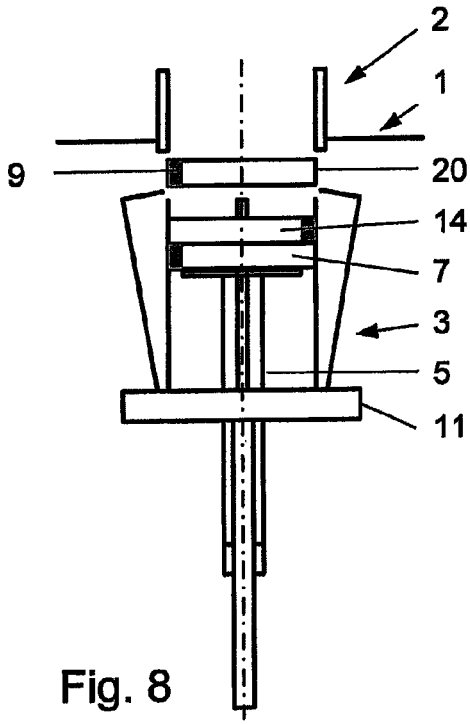

As indicated with the double arrow 21 in FIG. 7, the table 11 and thus also the lift plate 6 with thereon disposed two layers 7 and 14 is rotated by 180° around the vertical axis 13. In the process, the backs 9 of the printed products are respectively moved to the opposite side of the pressing device 3, as shown in FIG. 8. The lift 5 is again moved downward, wherein this movement is also controlled and the measured thickness of the first layer 7 is taken into consideration. It is thus assumed that the additional layer 20 also has the same thickness as the first layer 7 and/or the second layer 14. In principle, however, a different thickness can be taken into consideration for the layer 20 when lowering the lift 5. Furthermore conceivable is that the thickness of the second layer 14 is determined and that the respective value is taken into consideration for accommodating the additional layer 20. Also conceivable is that the thickness of the second layer 14 is measured and this value is taken into consideration for accommodating all subsequent layers. Thus, it is essential that at least the thickness of one layer 7, 14, or 20 is determined and is taken into consideration for the subsequent lowering of the lift 5.

Figure 9:
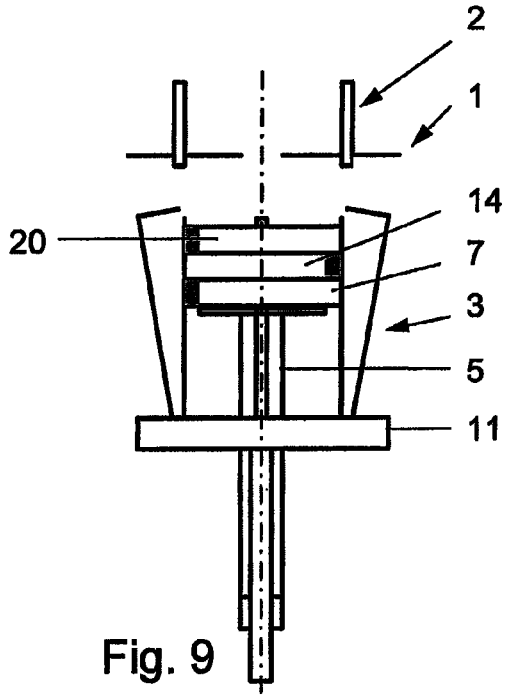

A stack composed of three layers 7, 14, and 20 is obtained once the additional layer 20 is dropped from the stacking device 2 onto the pressing device 3, as shown in FIG. 9. The backs 9 of the printed products in the successive layers 7, 14, 20 are respectively located on the opposite side of the pressing device 3, as shown, thereby ensuring that the resulting bundle has a horizontal orientation.

Figure 10:
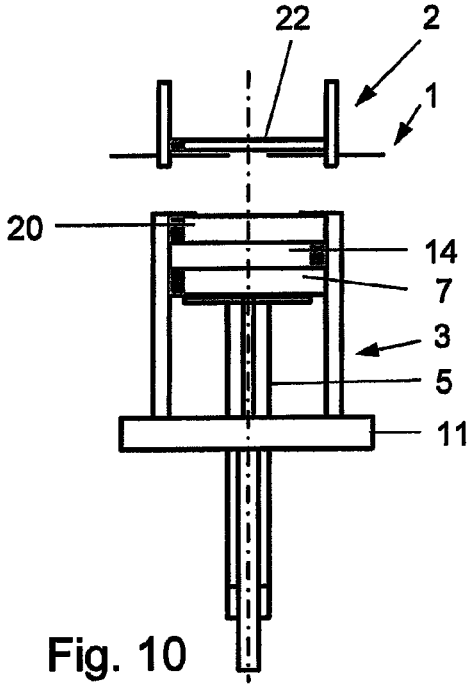
Figure 11:
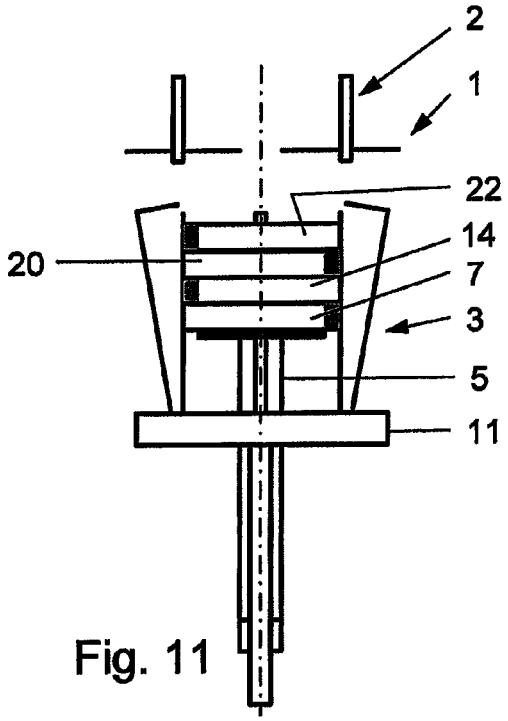
Figure 12:
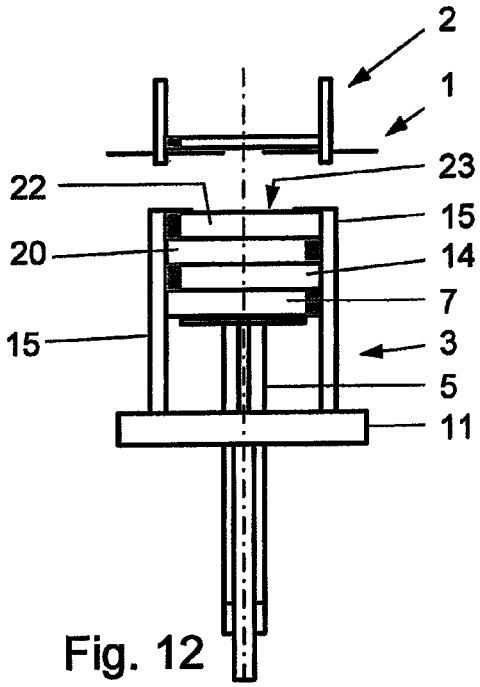
Figure 13:
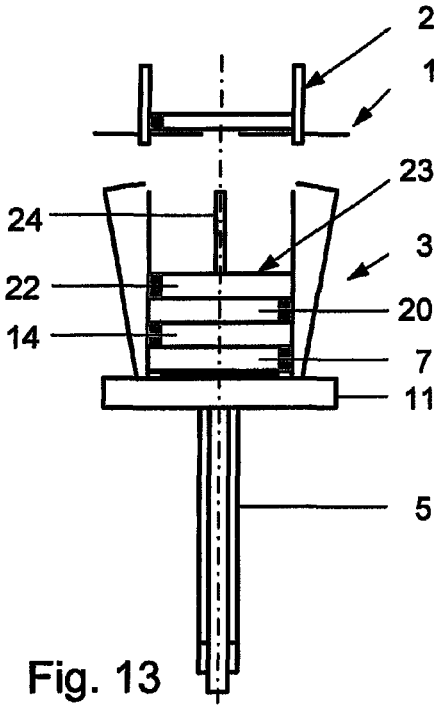
Figure 14:
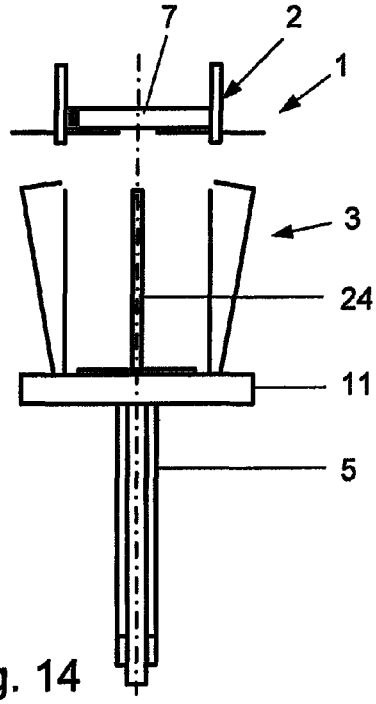
Figure 15:
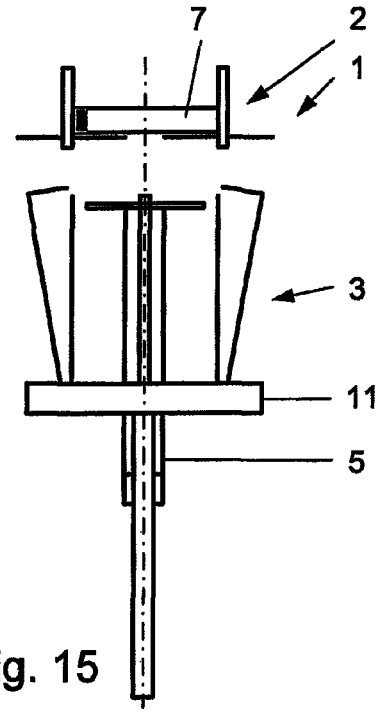

Corresponding to FIGS. 10 and 11, an additional layer 22 is formed, is dropped and is finally compressed, as shown in FIG. 12. The layers 7, 14, 20 and 22 jointly form a bundle 23, as shown in FIG. 12. The lift 5 is then moved to a lower position, as shown in FIG. 13. The bundle 23 is ejected from the pressing device 3 with the aid of the ejector 24 and is then supplied to a further processing location that is not shown herein. During the process of lowering the lift 5 to the aforementioned, lower position and during the ejection, a different first layer 7 for a following bundle can already be formed, as shown in FIGS. 14 and 15. For this, the above-described operation is repeated and the lift 5 is moved to the upper position, as shown in FIG. 2. The previously determined thickness D and/or D' can be taken into consideration for the advance to this upper position, so that the upper position also represents the optimum position for dropping the first layer 7.

It will be understood that the above description of the present invention is susceptible to various modifications, changes and adaptations, and the same are intended to be comprehended within the meaning and range of equivalents of the appended claims.

What is claimed is:

1. A method for forming bundles inside a bundle former having a holding space, comprising:

depositing at least one layer, composed of at least one printed product of a bundle, onto a lift;

subsequently compressing a respective one of the layers;

determining a thickness of the respective layers, wherein the determining comprises determining the thickness of a first layer during the compressing of the first layer; and;

moving the lift downward, as a function of the previously determined thickness of the compressed first layer plus a distance which corresponds to a height difference between a compressed layer and a non-compressed layer, for accommodating a following layer of the bundle or a layer of a following bundle.

2. The method according to claim 1, wherein:

the depositing includes depositing a first layer onto the lift while the lift is located in a first, upper position;

the compressing step comprises compressing the first layer;

the determining step comprises determining the thickness of the first layer;

the moving step comprises lowering the lift to a second position corresponding to the thickness that is determined for the first layer in order to accommodate a second layer; and the method further comprises compressing the second layer.

3. The method according to claim 1, wherein the compressing is performed by raising the lift.

4. The method according to claim 1, further comprising forming respective layers in a stacking device above the holding space and then depositing or dropping the respective layers onto the lift.

5. The method according to claim 1, wherein the compressing comprises compressing the respective layers by pressing them against at least one press flap.

6. The method according to claim 1, including forming the layers so that they have respectively the same thickness.

7. The method according to claim 1, further comprising rotating the holding space together with a therein disposed layers at least once by 180° around a vertical axis.

8. A method for forming bundles inside a bundle former having a holding space, comprising:

depositing at least one layer, composed of at least one printed product of a bundle, onto a lift;

subsequently compressing a respective one of the layers;

determining a thickness of the respective layers, wherein the determining comprises measuring the thickness of a non-compressed first layer and computing a presumed thickness of said non-compressed first layer when compressed, taking into account an air factor;

moving the lift downward, corresponding to the presumed thickness of the first layer when compressed for accommodating a following layer of the bundle or a layer of a following bundle.

9. An apparatus for forming bundles composed of at least one layer of printed products, comprising:

a lift, wherein an area above the lift constitutes a holding space to accommodate the at least one layer, the lift being adapted to lower the at least one layer;

at least one press flap against which the at least one layer can be pressed by raising the lift;

a control unit connected to control movement of the lift; and a thickness determining device coupled to the control unit and arranged to determine a thickness of the at least one layer in the holding space, wherein the lift is controlled by the control unit to be lowered a distance corresponding to a previously determined thickness of a preceding compressed layer plus a distance which corresponds to a height difference between the preceding compressed layer and a following non-compressed layer to accommodate the following non-compressed layer in the holding space.

10. The apparatus according to claim 9, wherein the thickness determining device is integrated into the lift.

11. The apparatus according to claim 9, wherein the thickness of the at least one layer is determined by the thickness determining device during the compressing of the layers.

12. The apparatus according to claim 9, further comprising a stacking device arranged above the holding space to form the at least one layer.

13. The apparatus according to claim 9, wherein the apparatus comprises a compensating or pile stacker.

* * * * *